United States Patent [19]

White et al.

[11] 4,037,296

[45] July 26, 1977

[54] METHOD AND ARTICLE FOR TUFTING UPHOLSTERY AND THE LIKE, AND THE RESULTING ARTICLE OF MANUFACTURE

[75] Inventors: Douglas M. White, Stamps; Alga L. White, Lewisville, both of Ark.

[73] Assignee: The Alan White Company, Stamps, Ark.

[21] Appl. No.: 640,967

[22] Filed: Dec. 15, 1975

[51] Int. Cl.[2] ..... A44B 1/18; A47C 27/00

[52] U.S. Cl. ..... 24/90 B; 5/356

[58] Field of Search ..... 5/356, 204, DIG. 8, 5/31; 24/90 B, 156; 85/50 R, 50 B, 50 C

[56] References Cited

U.S. PATENT DOCUMENTS

| | | | |
|---|---|---|---|
| 1,225,114 | 5/1917 | Davis et al. | 5/356 |
| 2,235,078 | 3/1941 | Meisterhans | 85/50 R |
| 3,298,271 | 1/1967 | Krueger | 85/50 R |
| 3,591,876 | 7/1971 | Swindlehurst | 24/204 R |
| 3,744,097 | 7/1973 | Shepherd | 24/204 |
| 3,895,797 | 7/1975 | Moore | 24/DIG. 8 |

FOREIGN PATENT DOCUMENTS

| | | | |
|---|---|---|---|
| 707,974 | 4/1965 | Canada | 85/50 |

*Primary Examiner*—Paul R. Gilliam
*Assistant Examiner*—Andrew M. Calvert
*Attorney, Agent, or Firm*—Stevens, Davis, Miller & Mosher

[57] ABSTRACT

A method and article for reinforcing the holes made through non-woven material, particularly vinyl, suede and leather, used in tufting upholstery and the like, and an article of manufacture embodying same.

9 Claims, 4 Drawing Figures

FIG. 1
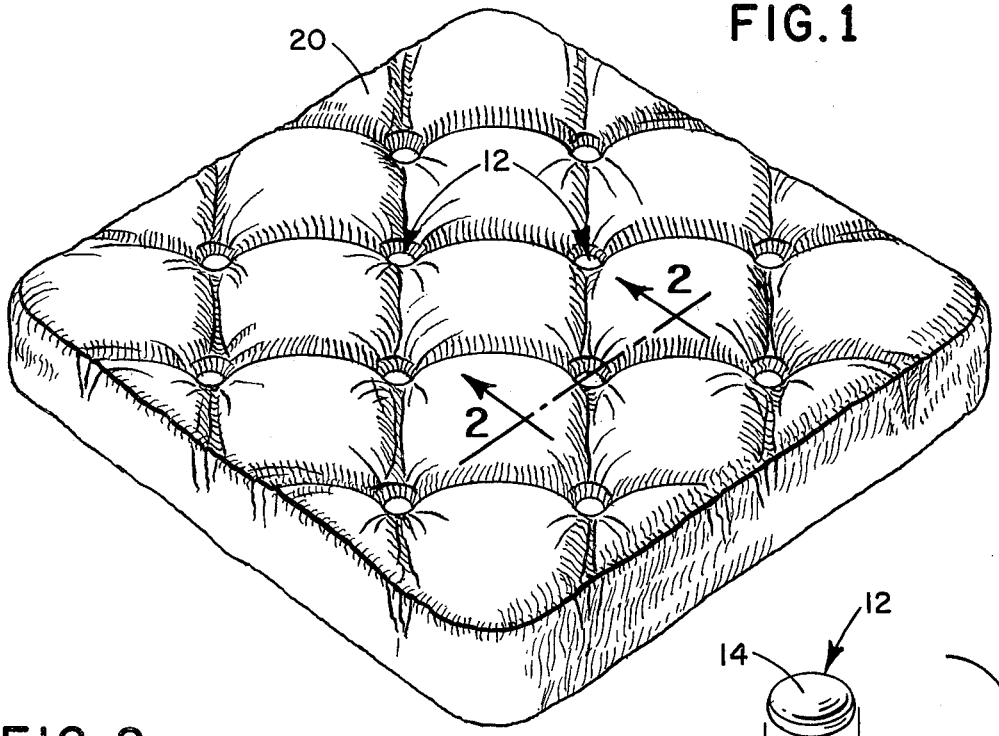
FIG. 2
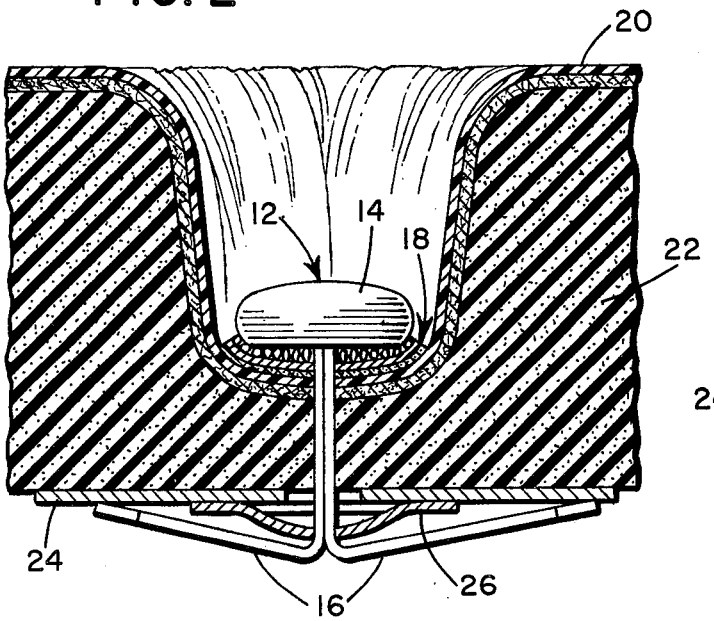
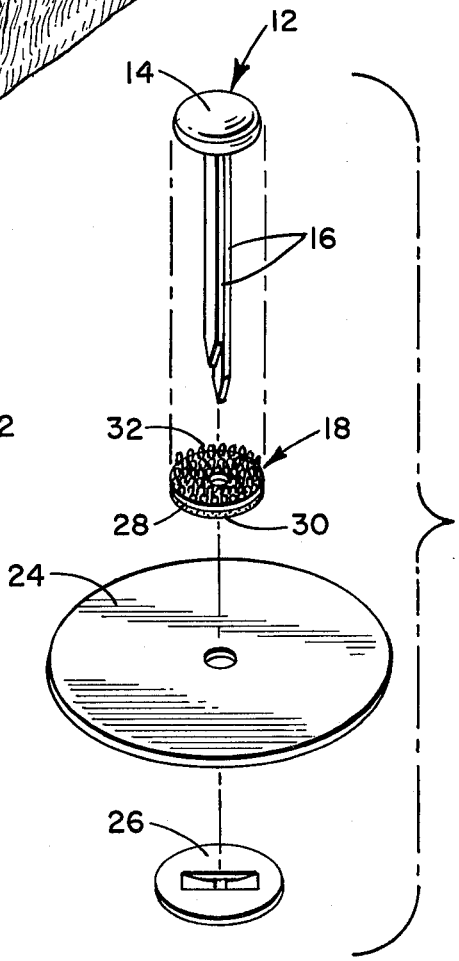
FIG. 3
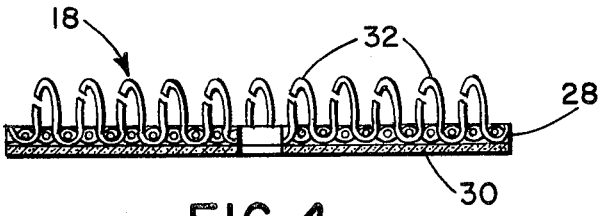
FIG. 4

METHOD AND ARTICLE FOR TUFTING UPHOLSTERY AND THE LIKE, AND THE RESULTING ARTICLE OF MANUFACTURE

BACKGROUND OF THE INVENTION

I. Field of the Invention

This invention relates to a method and article useful for reinforcing the holes made through non-woven upholstery material, particularly vinyl, suede and leather, employed in tufting upholstery and the like, and to the resulting article of manufacture. This invention is particularly adapted for use in reinforcing the holes made in vinyl tufted upholstery material during manufacture so as to prevent the button fasteners conventionally employed from tearing and stretching the holes in which they are positioned and thus avoiding the serious disadvantage of having the buttons pulled through the upholstery material rendering unsightly and unusable the pieces of furniture of which the upholstery is a part.

II. Description of the Prior Art

It is known in the prior art to reinforce the tufting hole made through fabric by fastening devices by means of a washer placed between the button head of a fastener and the outside face of the upholstery material. For example, U.S. Pat. No. 3,744,097 to Shepherd discloses one such expedient. The patent discloses a device and method for reinforcing the holes made through fabric by fastening devices used in the tufting process, and, more particularly, it relates to an improved fastener support washer. The patent discloses a rigid washer, preferably glass reinforced nylon, which is utilized to support the fabric surrounding a tufting fastener hole. FIG. 7 of Shepherd illustrates a washer 18 with attached teeth 20 and barbs 22 positioned substantially perpendicularly relative to the base of the washer. Shepherd's preferred method appears to involve slipping one of the washers 18 onto a fastener 10 with the teeth 20 projecting away from the button head as shown in his FIGS. 7 and 8. The fastener 10 is pushed through the fabric and the button pulled tight so that the teeth 20 on the washer 18 actually perforate the fabric and secure the fastener 10. When the washer 18 is secured in place the barbs 22 on the teeth 20 prevent the teeth, and thus the washer, from being unseated as stress is placed on the fastener 10. Stress exerted on the button fastener 10 is spread over the larger area of the fabric covered by the teeth 20 and not exerted solely on the hole within the fabric. Shepherd states that spreading or tearing about the hole created by the fastener 10 is substantially and perhaps completely eliminated. Shepherd also suggests that the unseating of the washer 18 can be prevented in other ways than through use of the teeth and barbs. For example, adhesive can be placed on the base of the washer to adhesively affix the washer to the upholstery fabric.

The Shepherd patent discloses a washer, rigid in structure, which is utilized with an upholstery fabric, and is not disclosed for use with a non-woven tufted upholstery material such as vinyl, suede, leather, or similar materials. In fact, the teeth and barbs of the Shepherd washer penetrate between the yarns of the upholstery fabric, and if utilized with a non-woven material, such as a vinyl-type material, would cut the vinyl-type material with a knife-like action which would soon result in the button fastener being pulled through the more or less spreading cut edges of the material. Even if the disclosed adhesive were used on the back of a rigid washer (rather than the obviously preferred teeth and barbs) to fasten it to a non-woven material such as a vinyl-type material, the sharp edges of the rigid washer would also tend to exert a cutting action against the non-woven material with the cut rapidly spreading during use. Furthermore, the rigid disc-shaped washer of Shepherd would not adhere well to a non-woven material such as a vinyl-type material since it would not conform to the contours of the upholstery material, and the vinyl or similar upholstery material would not be as porous as the fabric upholstery material of Shepherd which facilitates adhesion between the washer and woven fabric.

SUMMARY OF THE INVENTION

The present invention is concerned with improvements in the method and an improved article for reinforcing the holes made through non-woven material such as vinyl, suede and leather, and particularly vinyl, used in tufted upholstery, and with the resulting article of manufacture. The method and article of the present invention will strengthen the holes in non-woven (such as vinyl-type) upholstery material through which the button fasteners are extended thereby preventing them from being pulled through the non-woven upholstery material rendering the upholstered piece of furniture unsightly and soon unusable. In other words, the method and article of the invention will prolong the beauty and the useful life of a tufted piece of furniture utilizing a vinyl or similar type of material as the upholstery material.

The present invention comprises utilizing a pliable washer, preferably of woven nylon construction and with an adhesive affixed to the back side, positioned between the fastener and the non-woven upholstery material. The adhesive on the back side of the pliant washer will cause it to remain fixedly positioned to the vinyl-type upholstery material despite flexing of the latter during manufacture and later use. The pliant nature of the washer will enable it to conform readily to the shape of the vinyl-type upholstery material and thus better adhere thereto, while the construction of the washer being of a very strong yet flexible configuration, such as woven nylon, will result in the washer possessing great strength and resistance to tearing and stretching.

The improved method of tufting non-woven upholstery material comprises the steps of melting a hole in the non-woven upholstery material and affixing thereto an apertured pliable reinforcing washer so that the aperture of the said vinyl-type upholstery material and the aperture of the washer are in substantial vertical alignment. Thereafter, a conventional prong button fastener is extended through the aperture of the washer and the vertically aligned hole within the vinyl-type upholstery material, through a layer of foam positioned under the upholstery material, and through the apertures of a conventional fiber washer and a conventional metal washer. Subsequently, the prongs of the prong button fastener are bent so as to create a tuft in the upholstery material. This improved tufting method reinforces the hole in the vinyl-type upholstery material so that the stress is placed on the upholstery material by the prong button during use, the stress does not tear or stretch the vinyl-type upholstery material or allow the prong button fastener to pull through the hole in the upholstery material rendering it unsightly and unusable.

The improved tufting method of this invention includes the feature of needle-melting a hole in the vinyl-type upholstery material instead of punching it as is common industry practice. A substantial number, say 25 to 50, layers of the vinyl-type upholstery material in the form of a stack are needle-melted with a heat drill machine. The hot tip of the needle melts through a cutting of between 25 and 50 layers of the vinyl-type material at one time.

From the foregoing, it will be apparent that this invention has as one of its principal objects the provision of a method and article for effectively reinforcing the holes made through non-woven material such as vinyl, suede and leather, and particularly vinyl, used in tufted upholstery.

More particularly, an object of this invention is to provide an improved fastener support washer, for use in combination with the conventional fasteners used in tufting upholstery, for reinforcing the holes made through non-woven material for the fasteners so as to prevent the non-woven material from stretching or tearing and thereby allowing the fasteners to pull through and destroy the beauty and usefulness of the tufted piece of furniture.

Another object of the invention is to provide improved methods for tufting non-woven vinyl-type upholstery including in combination an improved way of forming a hole in vinyl-type upholstery fabric and an improved way of reinforcing the hole so that in a tufting application the fastener will not pull through the hole, with stretching and tearing of the vinyl-type upholstery material.

A further object of the invention is to provide an improved pliable upholstery reinforcing washer, for use with vinyl-type tufted upholstery, which is easily affixed to the upholstery.

A still further object of the invention is to provide a new improved type of non-woven tufted upholstery.

A more general object of the invention is to provide a method and article for economically improving the long-term durability and beauty of a relatively inexpensive vinyl-type of tufted furniture.

BRIEF DESCRIPTION OF THE DRAWINGS

FIG. 1 is a perspective drawing of a tufted cushion utilizing the method and article of the invention in conjunction with a non-woven material.

FIG. 2 is a sectional view illustrating the manner in which the pliable upholstery reinforcing washer is assembled with the fastener in a tufted piece of upholstery.

FIG. 3 is an exploded view of the components of the tufted upholstery fastener including the novel washer.

FIG. 4 is a cross-sectional view of the novel washer.

DETAILED DESCRIPTION OF THE PREFERRED EMBODIMENT

FIG. 1 discloses a tufted cushion comprising a vinyl-type of non-woven upholstery material 20 with the tufts formed by the button prong fasteners 12. The vinyl-like tufted cushion in FIG. 1 will have a general appearance very similar to that of a much more expensive leather tufted cushion but where the holes through which the button prong fasteners are positioned (in the leather tufted cushion) are much less resistant to stretching and tearing.

FIG. 2 shows the button pronged fastener 12 comprised of the button head 14 and the prongs 16. The prongs 16 are positioned through a aperture in the pliable upholstery reinforcing washer 18, through an aperture or hole in the vinyl-type non-woven upholstery material 20, through the padding foam 22 located behind the upholstery material 20, through an aperture in the rigid fiber washer 24, and finally through an aperture in the smaller metal washer 24, and finally through an aperture in the smaller metal washer 26. The prongs 16 of the prong button 12 are bent sideways on the back side of the metal washer 26 so as to compress the aforementioned elements together and form a tuft in the upholstery.

It should be noted that the pliable upholstery reinforcing washer 18 will readily conform to the shape (and changes of shape) of the vinyl-type non-woven upholstery material on which it is adhesively and fixedly positioned. It should also be noted in FIGS. 2, 3 and 4 that the pliable washer 18 comprises a base 28, preferably of a woven nylon construction, with an adhesive backing 30 applied to the base 28, and "Velcro" loops 32 interrupted so that they function as hooks on the side of the washer adjacent the button prong head 14. The Velcro hooks 32 perform a salutary function of cushioning the button prong head 14 against the vinyl-type non-woven upholstery material 20. The strength of the pliable washer 18 supplemented by the cushioning effect of the hooks thereby enables great stress to be placed on the button prong fastener 12 by the non-woven vinyl-type material 20 without a detrimental tearing or stretching effect being imparted to the aperture in the vinyl-type upholstery material 20. Without this reinforcing function performed by the pliable washer 18, a tufted piece of furniture constructed of a relatively inexpensive vinyl-type non-woven material will not have the long term strength and durability of tufted leather furniture.

This invention in a simple and economical way enables a furniture manufacturer to reduce the durability differential between an inexpensive non-woven vinyl-type tufted piece of furniture and a leather piece of furniture when the latter is made by the heretofore conventional methods.

FIG. 3 illustrates an exploded view of one embodiment of the present invention. It illustrates how the novel pliable upholstery reinforcng washer 18 is first positioned on the prong 16 of the prong button 12, then the prongs 16 are slidably received by the aperture of the rigid fiber washer 24, and finally are slidable received by the aperture of the metal washer 26 before each prong is bent sideways in a direction opposite that of the other so as to prevent the button prong from pulling out of the tufted upholstery when placed under stress.

It should be noted that the present invention comprises the article 18 and a method of using it, and that the prior art discloses the use of the other components in conjunction with each other in a tufting process. The present invention also comprises the tufted article of manufacture.

The pliable washer 18 is not limited to use in the particular configuration illustrated in FIG. 3, but can be used with other fasteners known per se to the art. The pliable upholstery reinforcing washer 18 can be utilized to reinforce the hole in a vinyl-type of tufted non-woven material regardless of the variety of fastener means with which it may be used.

FIG. 4 further illustrates the pliable upholstery reinforcing washer comprising a preferred embodiment of a nylon woven base 28, an adhesive backing 30 on the side remote from the button head 14, and Velcro loops 32 interrupted so that they function as hooks on the side of the washer 18 adjacent to the button head 14. Although this is a preferred embodiment of the invention, the invention is not limited to this particular embodiment, since the invention will work well without the Velcro hooks 32 and their associated cushioning effect with respect to the fastener head 14.

The novel pliable washer will also perform its function in reinforcing the aperture in a vinyl-type tufted non-woven upholstery material if constructed of a fiber other than nylon (such as a polyester) and in a manner other than woven (such as knitted).

With each of the above-mentioned and other possible embodiments of the present invention, however, it is advantageous to use an adhesive backing to rigidly affix the washer to the vinyl-type non-woven upholstery material. Otherwise the washer would be free to move laterally with a rubbing action and could thus weaken the upholstery material positioned therebelow and facilitate the eventual pulling through of the button head 14 of the fastener 12. Any conventional adhesive may be employed, such as an epoxy-based adhesive composition.

With the preferred method of the present invention, a heat-drilled machine needle melts through a cutting of the between 25 and 50 layers of vinyl-type non-woven material with the hot tip imbedded in a cardboard shield over formica that is placed on the cutting table. As far as is known, the general industry practice heretofore has been to use a punching process in creating holes in the vinyl or vinyl-type non-woven upholstery material to be utilized in tufting. After the needle-melting of the apertures in the vinyl-type material 20 has been accomplished, the prong button 12 is slidable inserted through an aperture in the reinforcing washer 18. Next the prongs 16 of the fastener prong button 12 are placed through an aperture in the padding foam 22, an aperture in the fiber washer 24 and an aperture in the metal washer 26. Subsequently, the end portion of the prongs 16 are bent each in a direction opposite to the other at a substantially perpendicular angle to the longitudinal axis of the remaining stem 16.

Another possibility with the improved method of tufting non-woven upholstery material described herein would be to place the pliable reinforcing washer 18 on the vinyl-type non-woven upholstery material 20 subsequent to the needle meling and then insert the prong button fastener through the aperture in the washer 18 and the attached upholstery material 20.

In summary, it is possible either to first affix the pliable washer 18 to the fastener 12 before fastening the fastener 12 to the upholstery 20, or to first affix the pliable washer 18 to the non-woven upholstery material 20 and then fasten the fastener 12 to the upholstery.

It will thus be seen that there is provided a method and an article for most economically reinforcing the holes made through non-woven material, particularly vinyl, used in tufted upholstery, as well as the novel tufted upholstery itself. This will result in greater long term use and durability of the vinyl-type tufted upholstery.

What is claimed is:

1. A pliable upholstery-reinforcing washer for use with a fastener to tuft a vinyl-type non-woven upholstery material, said fastener comprising a prong button adapted to extend through an aperture in said non-woven upholstery material and a foam upholstery material positioned therebeneath, through an aperture in a rigid fiber washer and through an aperture in a metal washer with the button head of said prong button adapted to be disposed atop said non-woven upholstery material and with the prongs of said prong button bent sideways on the backside of said metal washer so as to tuft said material, said pliable upholstery-reinforcing washer comprising a pliable base having an aperture therein so as to slidably receive therethrough one of said fasteners and an adhesive on the side of said base adjacent said non-woven upholstery material, said pliable upholstery-reinforcing washer being adapted to be fixedly positioned on said non-woven upholstery material beneath the button head and atop said non-woven upholstery material whereby said pliable washer reinforces the hole in said non-woven upholstery material and prevents the button head from stretching and tearing said non-woven upholstery material adjacent the aperture therein.

2. A pliable upholstery-reinforcing washer as claimed in claim 1, wherein the washer comprises a nylon washer of a preferably woven construction whereby said washer is pliant so as to conform to the contours of said non-woven upholstery material therebeneath and sufficiently strong as to reinforce said non-woven upholstery material.

3. A pliable upholstery reinforcing washer as claimed in claim 1, wherein the pliable washer comprises a "Velcro" nylon washer with hooks fashioned on the side of the washer adjacent the button head whereby the hooks perform a cushioning function between the buttonhead and the non-woven upholstery material when stress is placed on said fastener.

4. A pliable upholstery reinforcing washer as claimed in claim 1, wherein the pliable washer is of substantially the same diameter as the buttonhead.

5. An improved vinyl-type non-woven tufted upholstery which comprises:

an apertured vinyl-type non-woven upholstery material;

an apertured pliable reinforcing washer with an adhesive on the side adjacent said non-woven upholstery material, so positioned on said non-woven upholstery material that both apertures are in substantial vertical alignment;

a layer of a foam upholstery material positioned under said material; and a fastener means extending through the aperture of both said pliable reinforcing washer and said non-woven upholstery material, through the said layer of foam upholstery material, and fastened in such a manner as to tuft said upholstery material.

6. An improved vinyl-type non-woven tufted upholstery as claimed in claim 5, wherein the fastener means comprises:

a prong button fastener comprising a button top and prongs;

a rigid fiber washer having an aperture positioned substantially in the center thereof;

a metal washer having an aperture positioned substantially in the center thereof whereby said prongs are slidably inserted through said non-woven upholstery material and said layer of foam upholstery material, through said rigid fiber washer and said metal washer, said prongs being bent sideways so as to maintain the layer of foam upholstery material under compression and thus form a tuft in said upholstery material.

7. An improved vinyl-type non-woven tufted upholstery as claimed in claim 5, wherein said pliable reinforcing washer comprises a nylon washer of woven construction whereby said washer is pliant so as to conform substantially to the contours of said non-woven upholstery material therebeneath and thereby reinforcing said non-woven upholstery material.

8. An improved vinyl-type non-woven tufted upholstery as claimed in claim 5 wherein said pliable reinforcing washer comprises a "Velcro" nylon washer with hooks fashioned on the side of the washer adjacent the top of said fastener whereby the hooks exert a cushioning effect between the buttonhead of the fastener and the non-woven upholstery material when stress is placed on said fastener.

9. An improved vinyl-type non-woven upholstery as claimed in claim 5 wherein said non-woven upholstery material includes apertures needle-melted therein with a heat drill machine.

* * * * *